US006578887B1

(12) United States Patent
Kienzler

(10) Patent No.: US 6,578,887 B1
(45) Date of Patent: Jun. 17, 2003

(54) PADLOCK WITH LOCKABLE SHACKLE

(75) Inventor: Helmut Kienzler, Meersburg (DE)

(73) Assignee: Stoba AG, Horn (CH)

( * ) Notice: Subject to any disclaimer, the term of this patent is extended or adjusted under 35 U.S.C. 154(b) by 0 days.

(21) Appl. No.: 09/806,303

(22) PCT Filed: Sep. 29, 1998

(86) PCT No.: PCT/CH98/00416

§ 371 (c)(1),
(2), (4) Date: Jun. 25, 2001

(87) PCT Pub. No.: WO00/19394

PCT Pub. Date: Apr. 6, 2000

(51) Int. Cl.[7] ..... B65D 27/30
(52) U.S. Cl. ..... 292/321; 292/307 R; 292/315
(58) Field of Search ..... 292/321, 307 R, 292/307 A, 315, 318, 322, 323, 326

(56) References Cited

U.S. PATENT DOCUMENTS

| | | | | | |
|---|---|---|---|---|---|
| 3,367,701 | A | * | 2/1968 | Wenk | 292/321 |
| 3,954,294 | A | * | 5/1976 | Iwamoto et al. | 292/318 |
| 4,082,336 | A | * | 4/1978 | Natkins | 292/318 |
| 4,245,374 | A | * | 1/1981 | Suzuki | 24/16 PB |
| 4,319,776 | A | * | 3/1982 | Moberg | 292/322 |
| 4,502,305 | A | * | 3/1985 | Bakker | 70/49 |
| 4,779,911 | A | | 10/1988 | Wu | |
| 5,123,686 | A | * | 6/1992 | Wenk | 292/321 |

FOREIGN PATENT DOCUMENTS

| | | |
|---|---|---|
| DE | 9200110 | 5/1992 |
| DE | 9208782 | 12/1993 |
| WO | 95/14985 | 6/1995 |

* cited by examiner

*Primary Examiner*—Gary Estremsky
(74) *Attorney, Agent, or Firm*—Crowell & Moring LLP

(57) ABSTRACT

The invention relates to a padlock (1) which is provided with a shackle (2). The padlock has a flat housing (3) in which retaining means (9, 10) are arranged. Retaining elements (7, 8) are positioned at the free end of the shackle (2"). The retaining means (9, 10) are located at a retaining plate (4) which is arranged in the interior of the flat housing (3). Preferably, the housing (3), shackle (2) and retaining plate (4) are manufactured in a single piece, i.e., they are firmly linked to each other. One of the advantages of the invention is that, once the shackle is locked, it cannot be opened except by breaking or deforming it so that tampering can be easily detected.

14 Claims, 2 Drawing Sheets

PADLOCK WITH LOCKABLE SHACKLE

BACKGROUND AND SUMMARY OF THE INVENTION

The present invention relates to a padlock with lockable shackle in accordance with the preamble of claim 1.

A plurality of such padlocks exist, because they are also known as padlocks (English). In particular, with such padlocks, wherein, once the shackle is locked, the padlock can no longer be opened without destroying it, there is the problem, on the one hand, of preventing as much as possible attempts to tamper with the lock and, on the other hand, of rendering said tampering visible and detectable.

Thus, for example, the U.S. Pat. No. 4,779,911 discloses such a padlock, which is constructed of few parts. Once the shackle has been locked, it cannot be opened without breaking it. In this respect the two ends of a U-shaped shackle, made of metal, are disposed in a box-shaped housing. In the unused, open state only one end of the shackle can be slid longitudinally between two stops and swung sideways in this housing. Thus, the shackle can be used as prescribed, for example, by inserting the free end into one eye or several eyes. Finally the free end can be inserted into the corresponding opening in the padlock housing, where there are springy retaining means, which are inaccessible from the outside and which at this stage hold these ends of the U-shaped shackle immoveably. Thus, the springy retaining means engage with an annular groove, designed on the end of the shackle. Now the padlock must be opened by serving the U-shaped shackle with a tool, thus rendering the padlock useless for reuse.

This prior art embodiment of a padlock is, indeed, simply constructed from only a few parts, but is exhibits some shortcomings, especially with respect to protection against tampering.

The object of the present invention comprised at this stage of providing such a padlock, which is believed to be even simpler in its construction and at the same time is believed to provide better protection against tampering.

The invention solves this problem with a padlock with the features disclosed in claim 1.

One advantage of such an inventive padlock is that it can be manufactured preferably in one piece and is very well protected against tampering owing to the fact that the locking members are not accessible from the outside and are not open in the interior of the housing. Since the padlock is manufactured in one piece, it still exhibits, despite its protection against tampering, the advantages of a simple construction. As an inexpensive mass produced article, such a padlock is especially suitable for application in areas requiring good protection or good protection against tampering.

Preferred designs of the invention follow from the dependent claims 2 to 9.

One embodiment of the present invention is explained in detail below with reference to the drawings.

DETAILED DESCRIPTION OF THE DRAWINGS

Figure 1:
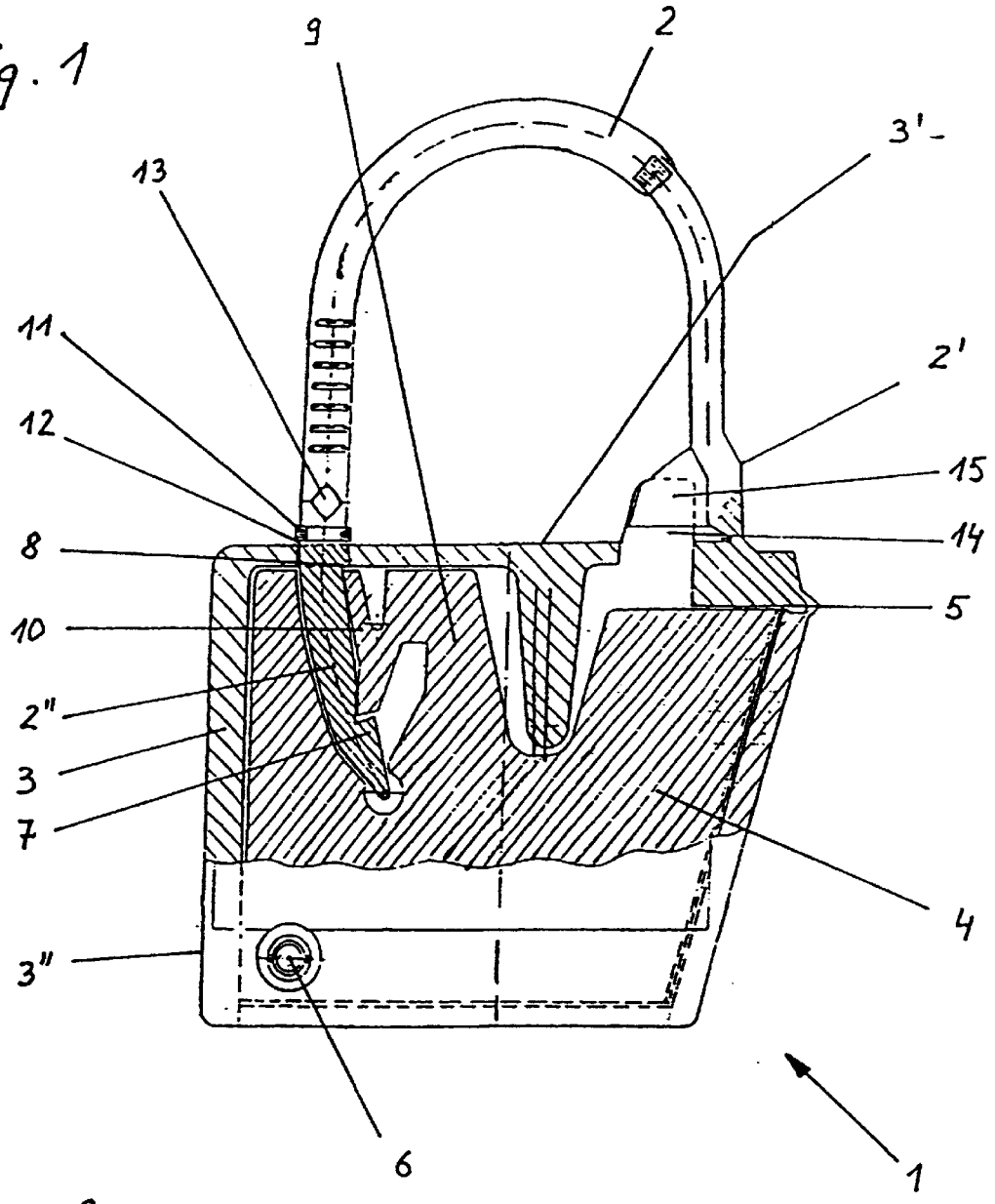
FIG. 1 is a top view of a detail of the inventive padlock in the closed position.
Figure 2:
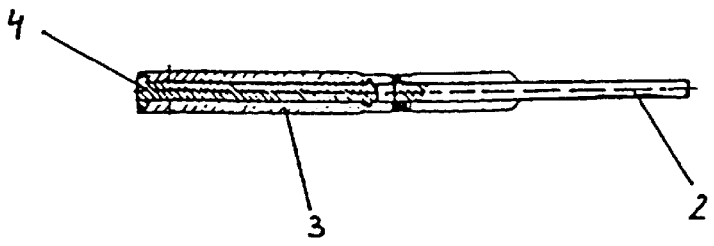
FIG. 2 is a longitudinal view of the padlock in FIG. 1.

FIG. 1 is a view of a detail of the inventive padlock 1 in the closed position, that is, with closed shackle 2. The padlock 1 exhibits a flat, shell-shaped housing 3, which exhibits at the top and on its front side closed walls 3' and 3". The interior of the housing 3 exhibits a retaining plate 4, which forms simultaneously the bottom and rear side walls 4' and 4" of the padlock 1. This retaining plate 4 is connected, on the one hand, to the housing 3 by way of the bridge 5 and is connected, on the other hand, in the bottom corner to the side walls of the housing 3 by way of mortising 6 or a rivet. Thus, the retaining plate 4 lies immoveably in the interior of the housing 3 and cannot be detached from it without visible tampering.

The shackle 2 is also connected with its one end 2' to the housing 3, preferably in one piece. The free end 2" of the shackle is designed as a retaining member and terminates in the closed position in the matching retaining means of the retaining plate 4.

Preferably a retaining tooth 7 and a similarly tooth-shaped stop cam 8 serve as the retaining members of the shackle 2. Said retaining tooth and stop cam act against each other. These retaining members 7, 8 engage with the matching retaining means of the retaining plate 4; thus, in this case preferably with a flexible tongue 9 with a rocking baby 10, which is also designed so as to be flexible. In the closed position of the padlock 1, depicted in FIG. 1, the shackle end 2" is held immoveably in the housing 3 by way of the rocking baby 10, that is by way of its two beveled end regions, which are moved against the retaining tooth 7 and the stop cam 8. Thus, the shackle end cannot be removed without breaking it.

This feature is supported by, among other things, the thickening 11, which is formed preferably on the shackle 2 in the transition to the shackle end 2". The thickening 11, for example in the form of a ring, is designed in such a manner that it closes the insert opening 12 for the shackle end 2" in the top side 3' of the housing 3 in the closed state and thus prevents a tool from being inserted into the gap formed by this opening 12 and the shackle end 2" for the purpose of tampering with the connection of the retaining members 7, 8 or the retaining means 9, 10. This process is also impeded by the preferably curved design of the shackle end 2", which prevents the insertion of a straight tampering tool.

If an attempt is supposed to be made to server the shackle 2 from the housing 3 with force, the shackle 2 is broken, first of all, at the preferably predetermined breaking point 13, thus rendering the tampering attempt detectable. Since this predetermined breaking point 13 lies above the thickening 11, the shackle end 2" remains in this case in the housing 3 of the padlock 1 and cannot be removed even with the use of a tool without also damaging the housing 3.

Even if this stage a tool could be inserted into the said gap, the result of the design of the retaining means in the form of a rocker 10 is that it will not be possible to displace to such an extent simultaneously both the bottom region of the rocker 10, which makes contact with the retaining tooth 7, and also the top part of the rocker 10, which makes contact with the stop cam 8, that the shackle end 2" could be removed from the opening 12 without visibly damaging the housing 3.

Furthermore, the shackle end 2' exhibits preferably a flat cone 15, which projects in the direction of the shackle opening and which in the closed state of the padlock 1 rests against cheeks 14, formed on both side surfaces of the housing 3, and is thus guided sideways from said cheeks.

Thus, it is prevented that the shackle end 2' in the transition area to the housing 3 is exposed to lateral stress, which could resist in the shackle 2 breaking in this area. Of course, the cone 15 could also be formed on the housing 3 itself and said cone could act between two parallel cheeks 15, disposed on the shackle end 2'.

Figure 3:
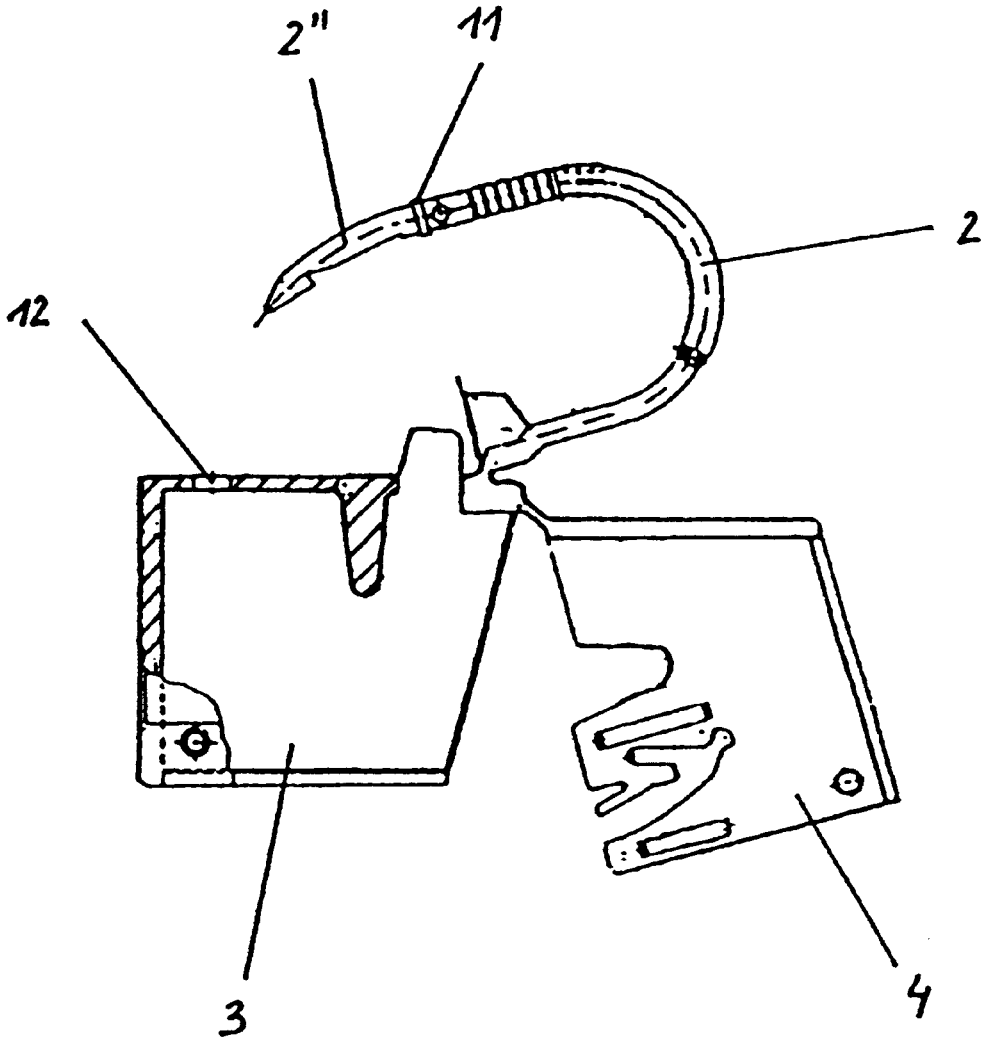
FIG. 3 is a view of the padlock blank in accordance with FIG. 1.

An especially significant advantage of the present padlock 1 lies now in the fact that it is constructed in such a manner that is can be produced in one piece, as follows from the view in FIG. 3. The three parts—housing 3, retaining plate 4 and shackle 2—can be manufactured as a single injection molded part. The areas are connected together by way of the bridge 5 and the shackle end 2'. Thus, the retaining plate 4 can be swivelled simply around the bridge 5 into the cavity of the housing 3 and connected immoveably to an open padlock 1 preferably by way of mortising 6.

Provided in this manner, is thus a one-piece padlock 1, also called padlock (English), which, in contrast to many such prior art one-piece padlocks, is protected especially against tampering, as presented above, owing to the completely closed locking area.

What is claimed is:

1. Padlock with a shackle, which projects from a face of a flat housing, a free end of the shackle exhibiting a retaining member, which in a closed position engages with a springy retainer in an interior of the housing and thereby closes a shackle opening through the face of the housing, wherein the housing is designed in a shape of a shell and the retainer is formed on a retaining plate, which is positioned in the interior of the housing, so that the retaining plate forms simultaneously at least a bottom wall of the housing which lies opposite the face, and wherein the retaining member is designed as a curved arm with at least two counter-acting toothed recesses on one side.

2. Padlock according to claim 1, wherein the shackle exhibits a thickening in a transition area to the retaining member.

3. Padlock according to claim 2, wherein the padlock is one single piece.

4. Padlock according to claim 1, wherein the retaining plate is connected by way of mortising to the housing.

5. Padlock according to claim 4, wherein the mortising is on a side of the housing opposite from the shackle.

6. Padlock according to claim 4, wherein the padlock is made of plastic.

7. Padlock according to claim 1, wherein when closed a shackle end that is connected to the housing is guided by way of mortising between cheeks formed on the housing.

8. Padlock according to claim 1, wherein the padlock is made of plastic.

9. Padlock according to claim 1, wherein the padlock is one single piece.

10. Padlock with a shackle, which projects from a face of a flat housing, a free end of the shackle exhibiting a retaining member, which in a closed position engages with a springy retainer in an interior of the housing and thereby close a shackle opening through the face of the housing, wherein the housing is designed in a shape of a shell and the retainer is formed on a retaining plate, which is positioned in the interior of the housing, so that the retaining plate forms simultaneously at least a bottom wall of the housing which lies opposite the face, wherein the retaining plate substantially entirely fills the interior of the housing, and wherein the retaining member is designed as a curved arm with at least two counter-acting toothed recesses on one side.

11. Padlock according to claim 10, wherein above an area with the retaining member the shackle exhibits a predetermined breaking point.

12. Padlock according to claim 11, wherein the breaking point is a rhombic or square recess in the shackle.

13. Padlock according to claim 12, wherein the padlock is one single piece.

14. Padlock according to claim 11, wherein the padlock is made of plastic.

* * * * *